US006095352A

United States Patent [19]

Lambert

[11] Patent Number: 6,095,352

[45] Date of Patent: Aug. 1, 2000

[54] SAFETY ACCESSORY FOR SABERING A BOTTLE OF SPARKLING WINE, AND AN IMPLEMENT FITTED WITH SUCH AN ACCESSORY

[75] Inventor: Robert Lambert, Egreville, France

[73] Assignee: ASDVE, Nemours, France

[21] Appl. No.: 09/277,723

[22] Filed: Mar. 29, 1999

[51] Int. Cl.[7] ..... B65D 49/12; B65D 55/16; B26B 27/00

[52] U.S. Cl. ..... 215/49; 215/306; 30/296.1; 220/375

[58] Field of Search ..... 215/14, 29, 47, 215/49, 50, 54, 306, 392, 393, 10; 220/277, 375, 737, 23.91, 23.87; D7/603; 222/80, 81, 87, 543; 30/165, 298.4, 296.1, 1, 1.5, 123, 124, 142

[56] References Cited

U.S. PATENT DOCUMENTS

| | | | |
|---|---|---|---|
| 534,946 | 2/1895 | Bates | 30/298.4 |
| 750,129 | 1/1904 | Schneider | 215/50 |
| 929,295 | 7/1909 | Eilers | 30/298.4 |
| 944,166 | 12/1909 | Anstead et al. | 215/54 |
| 1,155,331 | 10/1915 | Abel | 30/298.4 |
| 1,382,070 | 6/1921 | Fate | 215/DIG. 7 |
| 1,611,852 | 12/1926 | Cooper | 220/375 |
| 3,306,483 | 2/1967 | Bellafiore | 215/306 |
| 4,341,316 | 7/1982 | Bunge . | |
| 4,526,289 | 7/1985 | Schiemann | 220/375 |
| 4,627,546 | 12/1986 | Merrick . | |
| 4,728,037 | 3/1988 | Mainhardt | 220/375 |
| 5,758,914 | 6/1998 | Ioveno | 220/375 |
| 5,822,867 | 10/1998 | Sakai | 30/298.4 |

FOREIGN PATENT DOCUMENTS

| | | | |
|---|---|---|---|
| 365764 | 9/1906 | France . | |
| 884782 | 8/1943 | France | 220/375 |
| 988400 | 8/1951 | France . | |
| 2200857 | 7/1973 | Germany . | |
| 4119804 | 12/1992 | Germany . | |
| 158287 | 2/1921 | United Kingdom | 220/375 |

*Primary Examiner*—Nathan J. Newhouse
*Attorney, Agent, or Firm*—Birch, Stewart, Kolasch & Birch, LLP

[57] ABSTRACT

The invention relates to a safety accessory for sabering a bottle of sparkling wine, the accessory comprising a cord for retaining the neck of the bottle, the cord having a first free end fitted with means for enabling it to be connected to the neck of the bottle, and a second free end fitted with means for securing to an external support.

8 Claims, 3 Drawing Sheets

SAFETY ACCESSORY FOR SABERING A BOTTLE OF SPARKLING WINE, AND AN IMPLEMENT FITTED WITH SUCH AN ACCESSORY

BACKGROUND OF THE INVENTION

During celebrations, it is a common practice to open a glass bottle of sparkling wine (i.e. any type of wine that is not still), e.g. a wine made by the champagne method, by breaking the neck of the bottle by means of a bladed implement such as a saber or a large knife. This festive technique for opening a bottle can be referred to as "sabering" it. Although it is becoming more and more sought after to provide a special occasion that is splendid and original, it nevertheless suffers from a major drawback concerning the safety of people near the bottle. The neck of the bottle which is broken and which is made of glass is propelled by the pressure that exists inside the bottle at a speed that is quite high. The trajectory of this projectile can surprise both the person sabering the bottle and the people situated at various distances from the bottle and who are not always paying particular attention to the operation. This is giving rise to an increasing number of accidents due not only to the force of the bottle neck striking a person on its path, but also due to the sharp edge of the broken portion of the glass bottle neck which can do considerable damage, in particular it can sever an artery or a nerve, or it can gash a face.

OBJECTS AND SUMMARY OF THE INVENTION

That is why the present invention proposes designing a safety accessory for limiting the risk of an accident when sabering a bottle of sparkling wine.

To this end, the invention proposes a safety accessory for sabering a bottle of sparkling wine, the accessory comprising a cord for retaining the neck of the bottle, the cord having a free first end fitted with means enabling it to be connected to the neck of the bottle, and a second end fitted with means for securing it to an external support.

Thus, when the bottle is sabered, its neck which is violently projected in the general direction the bottle is pointing in by the pressure that exists inside the bottle is stopped in its flight at a certain distance from the bottle as soon as the retaining cord is tensioned. All that is then required of the person sabering the bottle is to make sure that no other person is situated at a closer range than the length of the cord. The bottle neck as retained by the cord drops vertically under the effect of its own weight and remains suspended from the cord without having any chance of reaching the people nearby. The bottle can thus be sabered in complete safety by means of an accessory that is of low cost and easy to use. In addition, the cord can be of a form and of a material that are pleasing in appearance and adapted to the festive or even solemn circumstances in which sabering is performed.

The means for connecting the first end of the cord to the bottle neck can be made in various different ways.

In a first embodiment, when the neck of the bottle is provided with wiring for retaining the cork, the means for connecting the first end of the retaining cord to the neck of the bottle are constituted by a hook for engaging the wiring.

In a second embodiment, the means for connecting the first end of the retaining cord to the neck of the bottle are constituted by an element for surrounding the neck.

In a third embodiment, the means for connecting the first end of the retaining cord to the neck of the bottle are constituted a cap for covering the neck.

Similarly, the means for securing the second end of the retaining cord can likewise be made in various different ways.

In a first embodiment, the means for securing the second end of the retaining cord are constituted by a hook.

In a second embodiment, when the support is constituted by the bottle, the means for securing the second end of the retaining cord are constituted by an element for surrounding the bottle.

In a variant, the means for securing the end of the retaining cord can be constituted by a base for covering the bottom of the bottle.

The invention also provides a sabering instrument comprising a blade and a handle, and provided with a safety accessory of the above type, the second end of the retaining cord being secured to the sabering instrument which constitutes the above-mentioned support.

In which case, advantageously, the second end of the retaining cord is secured to the handle of the sabering instrument. The sabering instrument can be constituted by any metal-bladed tool such as a saber or a kitchen knife, and having blunt edges in order to avoid accidental injury by the blade.

Finally, the invention provides a bucket for cooling a bottle of sparkling wine, the bucket being provided with a safety accessory of the above type. The second end of the retaining cord is secured to the bucket which constitutes the above-mentioned external support.

BRIEF DESCRIPTION OF THE DRAWINGS

Other characteristics and advantages of the invention will appear on reading the following description of particular embodiments given as nonlimiting examples.

Reference is made to the accompanying drawings, in which.

MORE DETAILED DESCRIPTION

Figure 1:
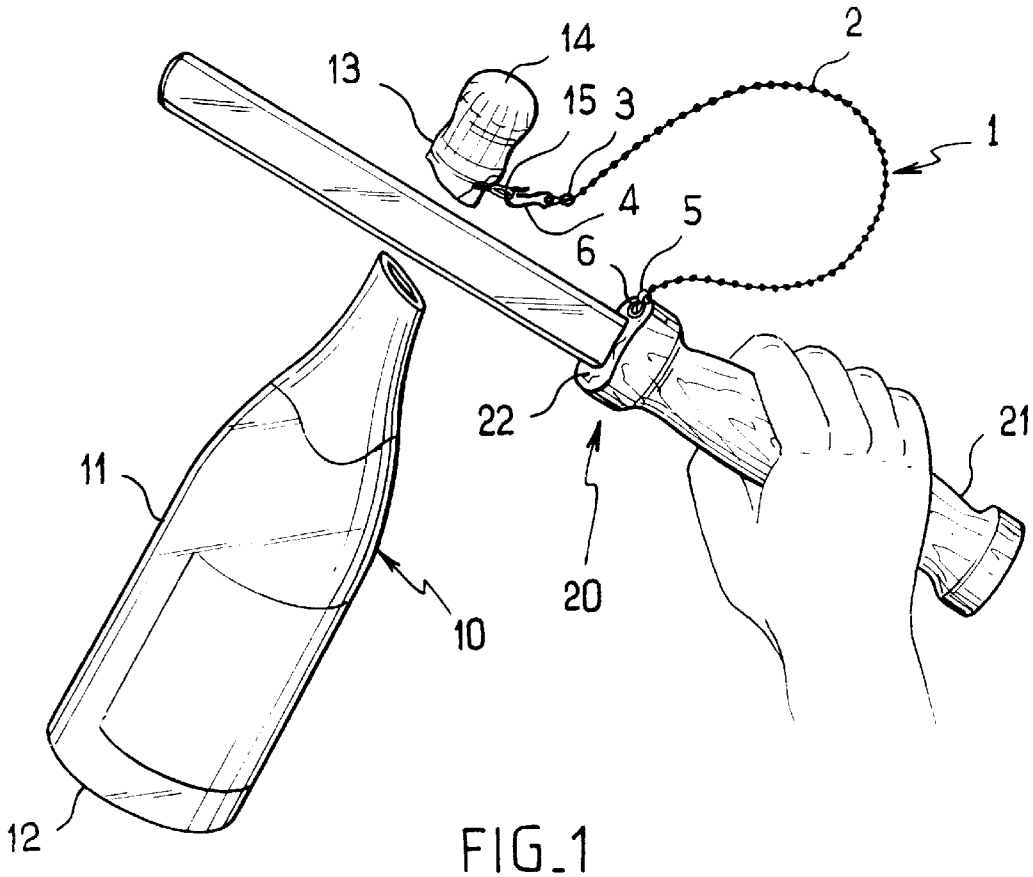
FIG. 1 is a perspective view showing a bottle of sparkling wine being sabered by means of a sabering instrument fitted with a safety accessory of the invention.

FIG. 1 shows a first embodiment of the invention. A bottle 10 of sparkling wine, i.e. a wine that is not still and that has been made, for example, by the champagne method, is sabered by means of a sabering implement 20 fitted with a safety accessory 1 of the invention.

The bottle 10 has a body 11, a bottom 12, and at its top, a neck 13 closed by a cork which, as is common for bottles of wine made by the champagne method, is held in place by wiring 15 which opposes the expulsion force exerted on the cork by the pressure that exists inside the bottle. The neck 13, the cork, and the wiring 15 are all covered in a protective film 14. In the configuration shown in FIG. 1, only the loop 15 of the wiring which is folded through a right angle sticks out from the protective film 14 for connection to the safety accessory 1.

In this case, the sabering implement 20 is constituted by a knife comprising a handle 21 (of wood, metal, bone, or any other material) having a front end face 22 from which there extends a metal blade 23 having an edge that is blunt (not sharp), the blade 23 being intended solely for striking the collar on the neck 13 of the bottle 10 so as to break the glass under the effect of the impact.

The safety accessory 1 is constituted by a retaining cord 2 made in this case in the form of a chain of metal beads (and in particular made of beads of a precious metal). However the cord 2 is not limited in any way to this form and it could be made to of any material (plastics material, synthetic or natural fiber, wood, etc.) and it could be of any form (a chain of links, a continuous thread, etc.). The cord 2 has a first end 3 which is fitted with a closable hook which is engaged in the loop 15 of the wiring on the neck 13 of the bottle 10. At its other end 5 (second end), the cord 2 is fitted with a washer 6 which is nailed to the front end face 22 of the wooden handle 21 of the sabering knife 20.

When the bottle 10 is sabered, the collar on the neck 13 is struck by the blade 23 of the sabering knife 11. Under the effect of the impact, the glass from which the bottle is made breaks in the vicinity of the neck 13, and the neck as detached in this way is projected violently in the direction the bottle 10 is pointing under the effect of the internal pressure that exists inside the bottle, and as shown in FIG. 1. The first end 3 of the cord 2, which end is free, accompanies the neck 13 as it travels until the cord 2 becomes taut.

The neck 13 is then stopped in mid-flight, since the second end 15 of the cord 2 is held by being secured to the handle 21 of the knife 20. It will be observed at this point that the length of the cord 2 can be selected as a function of the maximum distance which it is desired to allow the neck 13 to travel before stopping it in flight. Thus, for reasons of appearance, it is possible to select a cord 2 that is relatively long, whereas for reasons of greater safety, it may on the contrary be referable to select a cord 2 that is relatively short. In all cases, the person sabering the bottle must merely make sure that nobody else is situated within the range defined by the length of the cord 2.

The neck 13 as held by the cord 2 then drops vertically under the effect of its own weight and remains suspended from the cord 2 without it being possible for it to have reached any of the people present. The bottle 10 can thus be sabered in complete safety, independently of the attention that any of the people present may or may not be giving to the operation. It is also possible to saber bottles in public places such as restaurants, reception halls, or even outside.

Figure 2:
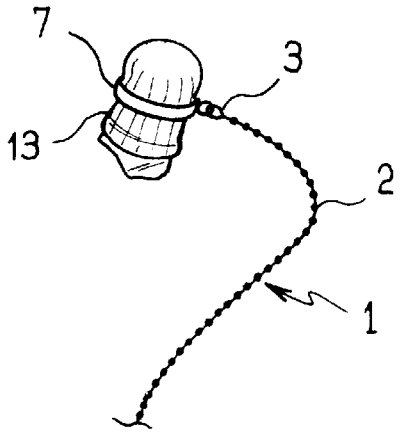
FIG. 2 is a fragmentary perspective view showing a variant embodiment of the means for connecting the first end of the retaining cord to the bottle neck.

FIG. 2 shows a first variant embodiment of the means for connecting the first end 3 of the retaining cord 2 to the neck 13 of the bottle. In this variant, the first end 3 of the cord 2 is fitted with an elastic ring 7 which fits round the neck 13. By way of example, the ring 7 may be rubber, possibly covered in cloth so as to improve its appearance (even though that reduces adhesion on the neck) Although not shown, it is equally possible on the same lines to encircle the neck 13 by means of a non-elastic strap of leather or the like that can be held by means of a conventional buckle, e.g. having claws.

Figure 3:
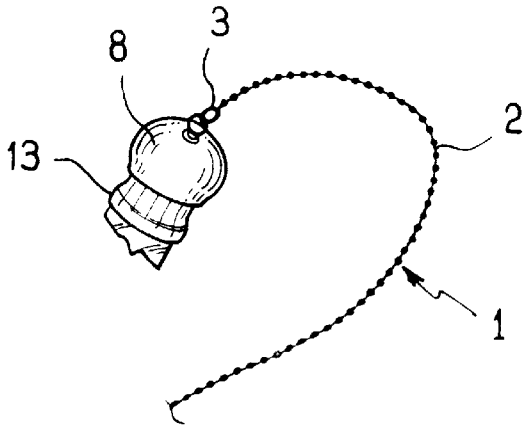
FIG. 3 is a view analogous to FIG. 2, showing another variant embodiment of the means for connecting the first end of the retaining cord to the bottle neck.

FIG. 3 shows a second variant embodiment of the means for connecting the first end 3 of the retaining cord 2 to the neck 13 of the bottle. In this second variant, the first end 3 of the cord 2 is fitted with an elastic cap 8 which fits over the end of the neck 13. As before, it is not essential for the cap 8 to be elastic and it would also be possible for such a non-elastic cap to be fitted at its free edge with bonding means such as a lace.

Figure 4:
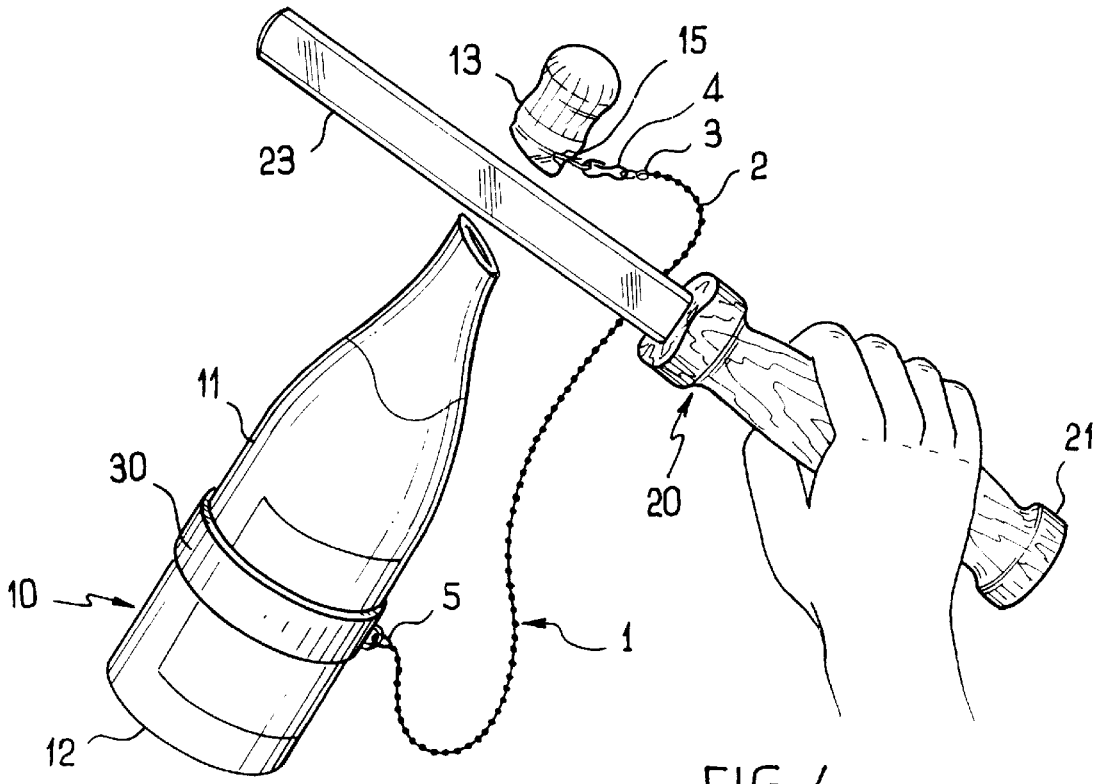
FIG. 4 is a view analogous to FIG. 1 showing another embodiment in which the second end of the retaining cord is secured to the bottle, the safety accessory being separate from the sabering instrument.

FIG. 4 shows a second embodiment of the invention. Unlike the first embodiment as described with reference to FIG. 1, the second end 5 of the retaining cord 2 of the safety accessory 1 is secured to the bottle 10 and not to the sabering knife 20. Specifically, the second end 5 of the retaining cord 2 is fitted with an elastic ring 30 which surrounds the body 11 of the bottle 10. This elastic ring 30 can be made of rubber, for example, thereby providing it with good adhesion to the glass constituting the bottle 10. However this example is not limiting in any way and it is possible, for example, to cover the rubber ring 13 in cloth so as to improve its appearance. It would also be possible, instead of an elastic ring, to use a non-elastic binding such as a leather belt or the like attached to the second end 5 of the cord 2 and fitted with any kind of closure buckle.

Figure 5:
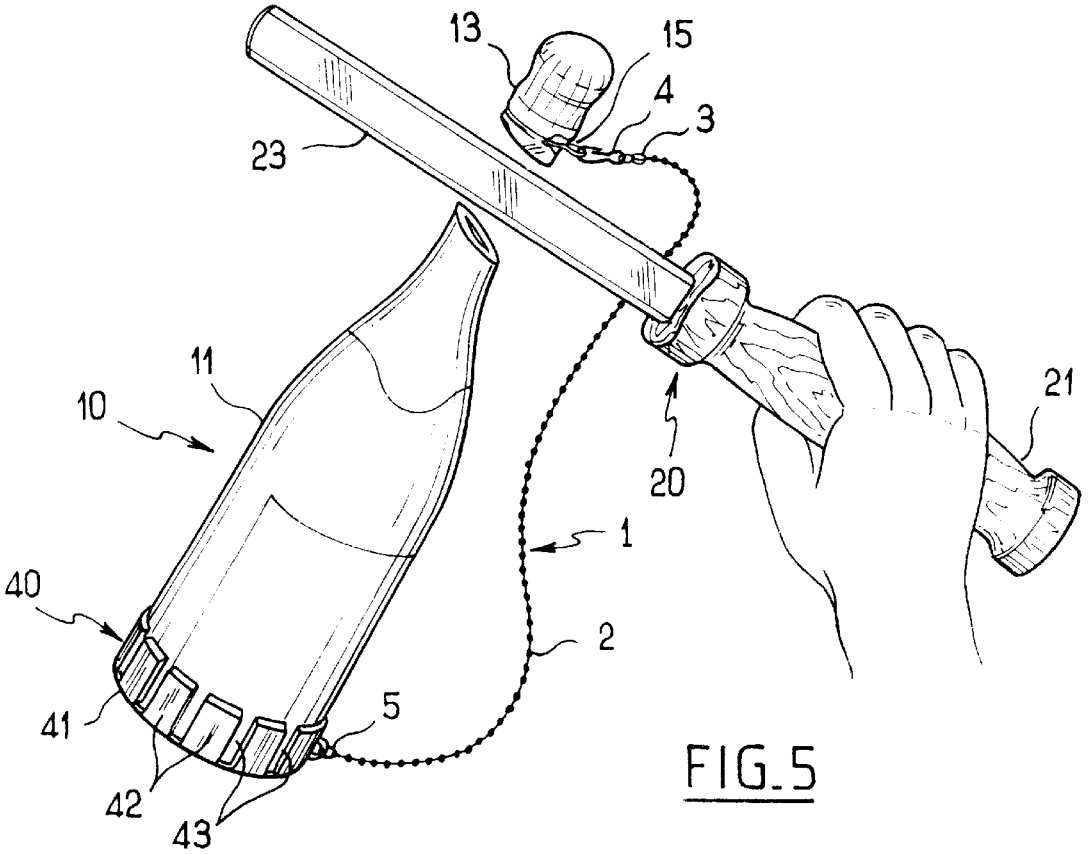
FIG. 5 is a view analogous to FIG. 4 showing a variant embodiment of the means for securing the second end of the retaining cord to the bottle.

FIG. 5 shows a variant embodiment of the means for securing the second end 5 of the retaining cord 2 to the bottle 10. In this variant, the second end 5 of the cord 2 is fitted with a base 10 that is fitted over the bottom of the bottle 10 (referenced 12 in FIGS. 1 and 4). The base 40 can be made of metal or of plastics material, and has its own bottom 41 in the form of a disk whose periphery has a cylindrical rim formed by a succession of fingers 42 separated by notches 43 which "bite" onto the periphery of the bottom of the bottle. These fingers 42 which are radially deformable in elastic manner give the cylindrical peripheral rim constituted thereby the ability to expand radially so as to enable the base 40 to be fitted tightly to the bottom of the bottle 10.

Figure 6:
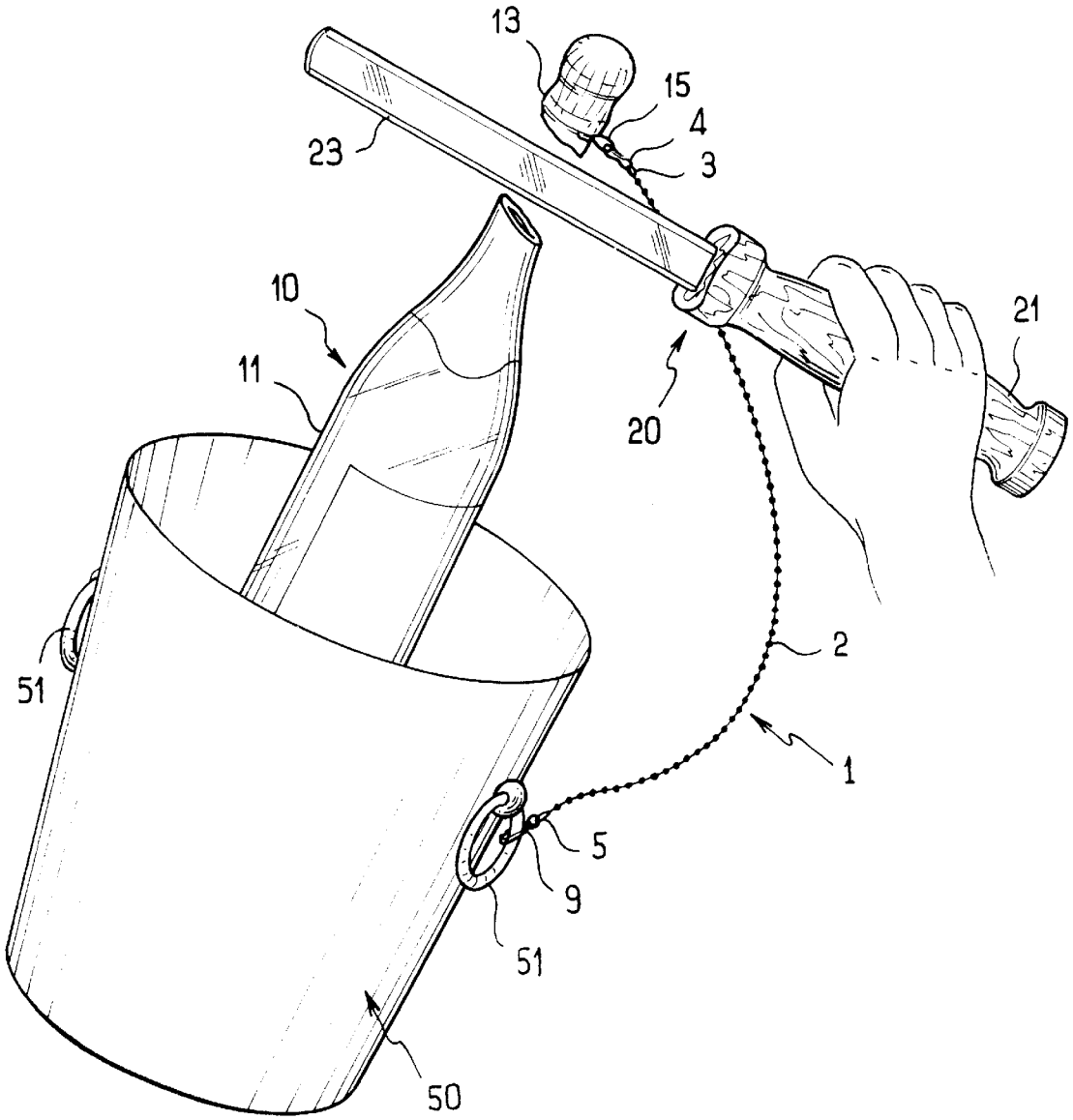
FIG. 6 is a view analogous to FIGS. 1, 4, and 5, showing yet another embodiment in which the fixed end of the retaining cord is secured to an ice bucket for containing the bottle.

FIG. 6 shows a third embodiment of the invention. In this case, the bottle 10 is associated with an ice bucket 50 for cooling the bottle, which bucket has ring-shaped handles 51 on either side. The retaining cord 2 of the safety accessory 1 is secured not to the sabering knife 20 but to the bucket 50. More precisely, the second end 5 of the cord 2 is provided with a closable hook 9 which is secured to one of the handles 51 of the bucket 50.

The invention is not limited to the embodiments described above, but on the contrary covers any variant using equivalent means to reproduce the essential characteristics of the invention.

For example, it would be possible to provide for the second end of the retaining cord to be secured to the user by means of a wrist strap.

What is claimed is:

1. A combination of a bottle, a retaining body and a safety device for sabering the bottle of sparkling wine, the combination comprising: the bottle having a body and a neck portion with a cork inserted therein, said neck portion provided with said cork being separable from the body when sabered, the device comprising a cord having a free first end provided with means for connection to the separable portion of the neck of the bottle, and a second free end provided with means for securing it to said retaining body when sabered.

2. The combination according to claim 1, wherein the neck of the bottle is provided with wiring for securing the cork, wherein the means for connecting the first end of the cord are constituted by a hook for engaging the wiring.

3. The combination according to claim 1, wherein the means for connecting the first end of the retaining cord to the neck of the bottle is constituted by an element for surrounding the separable portion of the neck.

4. The combination according to claim 1, wherein the means for connecting the first end of the retaining cord to the neck of the bottle is constituted by a cap for covering the separable portion of the neck.

5. The combination according to claim 1, wherein said means for securing the second end of the cord is constituted by a ring for surrounding the bottle.

6. The combination according to claim 1, wherein, when the retaining body is the bottle, the means for securing the second end of the retaining cord are constituted by a base for fitting over the bottom of the bottle.

7. The combination according to claim 1, wherein said retaining body is part of a sabering instrument.

8. The combination according to claim 1, wherein said retaining body is part of a cooling bucket which holds the bottle.

* * * * *